United States Patent [19]

Boughton et al.

[11] Patent Number: 4,526,851

[45] Date of Patent: Jul. 2, 1985

[54] MAGNETIC DEVELOPER COMPOSITIONS

[75] Inventors: Edward M. Boughton, Palos Verdes Estates, Calif.; Lewis O. Jones, Webster, N.Y.

[73] Assignee: TRW Inc., Redondo Beach, Calif.

[21] Appl. No.: 529,792

[22] Filed: Sep. 6, 1983

[51] Int. Cl.[3] ..... G03G 9/08

[52] U.S. Cl. ..... 430/106.6; 430/107; 430/108; 430/109; 430/122

[58] Field of Search ..... 430/106.6, 107, 109, 430/110, 120, 122

[56] References Cited

U.S. PATENT DOCUMENTS

| | | | |
|---|---|---|---|
| 3,213,026 | 10/1965 | Jordan et al. | 252/62.5 |
| 3,431,205 | 4/1969 | Otto | 252/62.55 |
| 3,448,052 | 6/1969 | Otto | 252/62.51 |
| 3,627,682 | 12/1971 | Hall, Jr. et al. | 252/62.54 |
| 3,639,245 | 2/1972 | Nelson | 252/62.1 |
| 3,895,125 | 7/1975 | Tsuchiya et al. | 427/18 |
| 4,148,640 | 4/1979 | Dulmage et al. | 430/120 |
| 4,189,390 | 2/1980 | Noguchi et al. | 430/111 |
| 4,192,902 | 3/1980 | Lu | 427/127 |
| 4,218,530 | 8/1980 | Lu | 430/107 |
| 4,239,845 | 12/1980 | Tanaka et al. | 430/122 |
| 4,251,616 | 2/1981 | Hendriks | 430/107 |
| 4,264,648 | 4/1981 | Ziolo et al. | 427/128 |
| 4,277,552 | 7/1981 | Asanae et al. | 430/112 |
| 4,286,037 | 8/1981 | Hectors et al. | 430/107 |
| 4,303,749 | 12/1981 | Gruber et al. | 430/39 |
| 4,315,064 | 2/1982 | Miyakawa et al. | 430/112 |
| 4,335,196 | 6/1982 | Ohmuro et al. | 430/112 |
| 4,336,565 | 6/1982 | Murray et al. | 430/35 |
| 4,362,803 | 12/1982 | Miyakawa et al. | 430/122 |

FOREIGN PATENT DOCUMENTS

| | | |
|---|---|---|
| 54-22835 | 2/1979 | Japan . |
| 2067777A | 1/1980 | United Kingdom . |
| 2066976A | 7/1981 | United Kingdom . |
| 2069161A | 8/1981 | United Kingdom . |
| 2083920A | 3/1982 | United Kingdom . |
| 2002726B | 8/1982 | United Kingdom . |

OTHER PUBLICATIONS

U.S. Ser. No. 339,778, filed 1/15/82, Brooks, "Method for Making Carbonaceous Materials".

Xerox, "Dielectric Measurement of Toner", 5/13/75.

*Primary Examiner*—John E. Kittle

*Assistant Examiner*—John L. Goodrow

*Attorney, Agent, or Firm*—John T. Wiedemann; Jeffrey G. Sheldon

[57] ABSTRACT

Magnetic developer compositions contain ferrous carbon. The ferrous carbon is a fibrous, particulate carbonaceous material comprising carbon fibers and a ferrous group metal component, where the ferrous group metal component is dispersed throughout the carbon fibers as nodules that are initmately associated with and at least partially bonded to the carbon fibers. The ferrous carbons can be used in monocomponent developers, and also in the toner and carrier used for dual component developers.

41 Claims, No Drawings

MAGNETIC DEVELOPER COMPOSITIONS

BACKGROUND

The present invention is directed to novel compositions useful for developing electrostatic images in electrophotography.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner is normally attracted to those areas of the layer which retain a charge, thereby forming a toner image corresponding to the electrostatic latent image. This powder image can then be transferred to a support surface such as paper. The transferred image can subsequently be permanently affixed to the support surface as by heat.

Two types of development systems, dual component and monocomponent systems, are used for developing an electrostatic image. For example, in the "magnetic brush" process, a two component developer material containing toner and magnetic carrier particles is carried by a magnet. The magnetic field of the magnet causes alignment of the magnetic carrier particles in a brush-like configuration. This "magnetic brush" is engaged with an electrostatic-image bearing surface and the toner particles are drawn from the brush to the electrostatic image by electrostatic attraction. See, for example, U.S. Pat. No. 2,874,063.

In magnetic-brush development of electrostatic latent images, the developer is commonly a triboelectric mixture of finely-divided toner powder comprised of dyed or pigmented thermoplastic resin mixed with coarser carrier particles of a soft magnetic material such as ground, chemically reduced iron oxide particles, magnetite or the like. The conductivity of the ferromagnetic carrier particles which form the "bristles" of a magnetic brush provides the effect of a development electrode having a very close spacing to the surface of the electrophotographic element being developed.

While ordinarily capable of producing good quality images, conventional developing materials in dual component systems suffer deficiencies in certain areas. For example, the toner particles, which can be very small, on the order of 10 microns, tend to scatter throughout the copying machine. This can adversely affect the operation of the machine and can result in powder clouding on the paper. Further, some of the toner particles do not get an electrical charge and end up on the paper as a dirty background.

Attempts have been made to solve this problem by slightly magnetizing the toner such as including magnetite in the toner so that toner particles that are not drawn from the magnetic brush by electrostatic attraction remain on the magnetic brush due to magnetic attraction.

However, attempts to solve this problem by including magnetite or other magnetic material in the toners has created a new set of problems. One problem is that the bulk density of the toners is increased, thereby increasing the cost to the customer in that less copying per pound of toner can be effected. Further, the higher density of the toner can result in attrition of the carrier particles and "toner impaction", two phenomena discussed below. Further, only relatively low amounts of magnetite can be included in the toner, or else the toner will not come off the magnetic brush. It is difficult to uniformly disperse magnetite in low quantities in toner particles.

Difficulties are also experienced with the carrier particles. For example, with existing components, it is difficult to design a carrier particle with specific electrical and magnetic properties to be useful for a specific copying machine. Further, the use of metal in the carrier products makes manufacture difficult, the metal being difficult to grind and compound.

Other problems with existing carriers result from chipping and other degradation and attrition of the carrier particles. These small particles can end up on the paper, resulting in a poor copy.

Further, as the carrier particles are recycled through many cycles, many collisions occur between carrier particles and other surfaces in the machine. As a result of these collisions, toner particles carried on the surface of the carrier particles tend to become welded or otherwise forced onto the carrier surfaces, a phenomenon known as toner impaction. This can result in a change of the triboelectric value of the carrier and can contribute to the degradation of copy quality by eventual destruction of the toner carrying capacity of the carrier. This problem is especially aggravated with carriers prepared from high density materials such as iron, magnetite, or steel.

Attempts have been made to overcome some of these problems using a single component magnetic toner rather than a dual component system. An advantage of a single component system is that carrier particles are not needed. However, difficulty has been experienced in making uniform toner particles in that they need to contain at least a binder, a magnetic material, and pigment. Forming uniform particles with these three ingredients can be difficult.

Further, the magnetic materials used, such as zinc-doped magnetite, can be expensive, contributing to the higher cost of monocomponent developing systems compared to two component developing systems.

Further, the magnetic material increases the bulk density of the toner particles, since ferrites have a bulk density of from 2.2 to 2.7 grams/cc and steel has a bulk density of from 2.3 to 3.5 grams/cc. This high bulk density of the toner particles results in a "heavy" magnetic brush. This can cause imperfections in the developed image as the brush scours away toner particles from the electrostatic image.

Another problem experienced with monocomponent developing systems is difficulty in formulating a particular toner. It is difficult to obtain a satisfactory balance of the magnetic, electrical, color, and physical properties of the toner particles while maintaining an adequate level of resin so that the toner particles fuse when heated to make good quality copies. For example, when using magnetite, it may in some instances be very difficult to achieve the desired magnetic moment for the toner without so overloading the toner with magnetite that the toner particles cannot be easily fused to fix the image.

In view of these problems, it is apparent that there is a need for improved developers for developing electrostatic images.

SUMMARY

The present invention satisfies this need and provides novel developers, both monocomponent and dual component developers, for use in developing electrostatic images. These developers contain as an essential ingredient ferrous carbon.

Ferrous carbon" is a fibrous, particulate carbonaceous material comprising carbon fibers and a ferrous group metal component, the ferrous group metal component being dispersed throughout the carbon fibers as nodules that are intimately associated with and at least partially bonded to the carbon fibers. By "ferrous group metal component" there is meant a metal of group VIII of the Periodic Table of the Elements, such as iron, cobalt or nickel, or alloys or mixtures of these metals. Preferably the metal is iron. Many of the fibers have a diameter in the range of about 0.02 micron to about 2.0 microns and a length to diameter ratio greater than about 5:1.

Ferrous carbon can serve both as a pigment and a magnetic component in a toner or carrier. Ferrous carbon can have a magnetic moment in excess of about 100 emu/gram, but only has a density of from about 2 to about 7 grams/cc, and a bulk density of less than about 1 gram/cc, and generally from about 0.1 to about 0.7 grams/cc. Thus, the toner in a two component developer can be made magnetic without unduly increasing its weight and without having to add an extra component to the toner.

For a monocomponent toner, one ingredient can provide both the necessary color and magnetic moment, thereby resulting in a uniform product that is easy to manufacture. Further, because of the low density of ferrous carbon, a soft brush with less image imperfections results. Because ferrous carbon can have a high magnetic moment, low loadings of the ferrous carbon are sufficient, thereby assuring that the toner has sufficient resin for adequate fusing.

A carrier containing ferrous carbon can have a low density due to the low density of the ferrous carbon. This helps avoid attrition of the carrier and reduces the susceptibility of the carrier particles to toner impaction.

A particulate, conductive, magnetic toner for use in a one component developer according to the present invention comprises binder and ferrous carbon. The binder is one that is solid at ambient temperature and is rendered molten under heating. The ferrous carbon is present in an amount sufficient that (i) the toner can produce a visible, black image on paper, (ii) the toner has a magnetic moment of at least about 20 emu/gram, and (iii) the toner has a resistivity of from about $10^6$ to about $10^{17}$ ohm-cm. The ferrous carbon contains from about 15 to about 80% by weight ferrous metal and from about 20 to about 85% by weight carbon. The toner preferably has a volume average particle size of from about 10 to about 20 microns and preferably has a weight ratio of binder to ferrous carbon of from about 3:17 to about 50:1.

All volume average particle size values presented herein are the values obtained with a Coulter Counter. All density values presented herein are the values for a single particle, i.e. "true" density values as measured with a pycnometer, unless indicated otherwise. For example, "bulk" density values are not the density of a single particle, but rather a mass of particles.

A carrier according to the present invention is particulate, magnetic, and conductive, and comprises binder and ferrous carbon. The ferrous carbon is present in an amount sufficient that the carrier has (i) a magnetic moment of at least about 25 emu/gram and (ii) a resistivity of about $10^6$ to about $10^{16}$ ohm-cm. The ferrous carbon contains from about 15 to about 80% by weight ferrous metal and from about 20 to about 85% by weight carbon. The carrier preferably has a volume average particle size of from about 20 to about 180 microns and preferably has a weight ratio of binder to ferrous carbon of from about 1:4 to about 50:1.

A particulate, magnetic, conductive toner for use in a dry developer that also includes carrier particles, comprises according to the present invention, binder and ferrous carbon. The binder is solid at ambient temperature and is rendered molten under heating. The ferrous carbon is present in an amount sufficient that (i) the toner can produce a visible, black image on paper, (ii) the toner has a magnetic moment of from about 5 to about 15 emu/gram, and (iii) the toner has a resistivity of from about $10^{10}$ to about $10^{14}$ ohm-cm. The ferrous carbon contains from about 15 to about 80% by weight ferrous metal and from about 20 to about 85% by weight carbon. The toner preferably has an average particle size of from about 10 to about 20 microns and preferably has a weight ratio of binder to ferrous carbon of from about 17:3 to about 50:1.

These and other features, aspects, and advantages of the present invention will become better understood with reference to the following description and appended claims.

DESCRIPTION

The present invention is directed to novel developers, both monocomponent and dual component developers, containing as an essential ingredient ferrous carbon.

Ferrous Carbon

Ferrous carbon is made by disproportionating a source of carbon, preferably carbon monoxide, in the presence of a ferrous metal component catalyst which may be a metal, an alloy, a carbide or other metallic substance. The source of carbon can also be a light hydrocarbon such as methane and/or propane or others. Ferrous carbon and methods for making the same are described in U.S. patent application Ser. No. 339,778 filed on Jan. 15, 1982; and U.S. patent application Ser. No. 99,789 filed Dec. 3, 1979, as well as in U.K. Pat. No. 2,002,726B published Aug. 18, 1982, all of which are incorporated herein by this reference.

In a preferred method for making ferrous carbon, a carbon monoxide-containing gas stream is passed into a bed containing particulate material to form a fluidized bed. The particulate material comprises a mixture of discrete ferrous group metal catalyst particles and discrete abradant particles selected from the group consisting of silica and alumina. The abradant particles have a particle size in the range of about 150 to about 180 microns and constitute about 10 to about 50 parts by weight of the total weight of the particulate material. The carbon monoxide-containing gas stream contacts the catalyst particles under conditions to cause at least some of the carbon monoxide to disproportionate and a fibrous carbonaceous material containing a ferrous metal component to form on the surface of the catalyst.

The catalyst particles having fibrous carbonaceous material formed thereon contact abradant particles in the bed to remove a substantial amount of the carbonaceous material containing a ferrous group metal component from the catalyst particles by abrading the fibers. The carbon-to-ferrous metal component ratio in the abraded carbonaceous material containing a ferrous metal component is increased before it exits the bed by contacting the carbonaceous material with carbon monoxide in a freeboard zone of the fluidized bed under conditions to cause the ferrous metal component of the carbonaceous material to catalyze the disproportionation of at least some of the carbon monoxide and additional carbon to form on the abraded carbonaceous material. The carbonaceous material containing a ferrous metal component is collected as it exits the bed.

The preferred ferrous carbon used in the present invention uses iron as a metal component. The iron in the ferrous carbon can be in the oxide form, carbide form, or in the alpha form, with the oxide form having the lowest magnetic moment and the alpha form having the highest magnetic moment. Also, the iron can be present in mixtures of these different forms or in alloys.

The ferrous carbon can contain from about 15 to about 80 percent by weight iron and about 20 to about 85 percent by weight carbon. The ferrous carbon has a resistivity within the same order of magnitude as conventional high conductivity carbon blacks (e.g. Cabot's Vulcan XC72R carbon black). The resistivity of the ferrous carbon is directly proportional to the amount of carbon it contains. The ferrous carbon can have a magnetic moment of from about 15 to about 160 emu per gram, the magnetic moment being dependent on the metal content of the ferrous carbon, as well as the form of the metal, e.g. Fe, $Fe_3C$, or $Fe_3O_4$.

There will now be described a monocomponent toner, a toner for a dual component system, and a carrier, each comprising ferrous carbon.

Monocomponent Toner

A particulate, conductive, magnetic toner for use as a one component developer for developing electrostatic charge patterns comprises binder and ferrous carbon. Preferably the ferrous carbon contains at least about 15 percent by weight iron, preferably in the alpha form, so that the toner has a magnetic moment of at least about 15 emu/gram and a resistivity of no more than about $10^{17}$ ohm-cm. If the ferrous carbon does not contain at least about 15 percent by weight iron, it is difficult to impart to the toner a magnetic moment sufficient to ensure that the toner is magnetically attracted and to avoid troubles such as fogging of the copying paper and scattering of the toner.

Preferably the ferrous carbon contains no more than about 80 percent by weight iron to ensure sufficient pigmentation or "blackness". Ferrous carbon having more than about 80% by weight carbon can be a fire hazard during the manufacturing process when it is first exposed to air and unduly expensive for use in toners. More preferably the ferrous carbon contains from about 20 to about 60 percent by weight iron.

Preferably there is sufficient ferrous carbon that (i) the toner can produce a visible, black image on paper, (ii) the toner has a magnetic moment of at least about 20 emu/gram, and (iii) the toner has a resistivity of at least about $10^6$ to about $10^{17}$ ohm-cm.

Accordingly, the weight ratio of binder or resin to ferrous carbon in the toner is from about 3:17 to about 50:1, i.e. if the toner contained only resin and carbon it would contain from 15 to 98 percent by weight resin and about 2 to about 85 percent by weight ferrous carbon. The weight ratio needs to be at least about 3:17 to have sufficient resin to adequately fuse. The weight ratio needs to be less than about 50:1 or else there is inadequate ferrous carbon for the toner to have a sufficiently high magnetic moment and a sufficiently low resistivity to develop electrostatic images.

For plain paper copiers, preferably the weight ratio of resin to ferrous carbon in the toner is about 3:1 to about 1:1; and for coated paper copiers preferably the ratio is from about 1:4 to about 7:13.

Preferably the magnetic moment of the toner is no more than about 135 emu/gram or else the ferrous carbon requires more than about 80 percent by weight iron, the disadvantages of which are discussed above, or the toner requires a weight ratio of resin to ferrous carbon of less than about 3:17, the disadvantage of which is discussed above.

Because the ferrous carbon can be tailor made for any toner by varying the metal content and the form of the metal to vary the "blackness", magnetic moment, and resistivity of the ferrous carbon, it is easy to tailor a particular toner for a particular use, without having to add additional ingredients to the toner.

Because the ferrous carbon has a density of from about 2 to about 7 grams/cc, the toner has a low density of only about 0.9 to 6 grams/cc, thereby providing a soft brush with less image imperfections. Preferably the density of the toner is less than about 2.5 grams/cc.

Preferably, the monocomponent toner has a volume average particle size of from about 10 to about 40 microns. All particle sizes presented herein are determined by Coulter Counter measurement which operates by detecting pulse-changes in the electrical field of a conducting liquid suspension of fine particulate samples. As that suspension is passed through an orifice, the magnitude of the pulse is proportional to the particle size. Since ferrous carbon is not spherical due to the long carbon fibers, in many instances the toner particles, particularly particles containing a high level of ferrous carbon, are not spherical. Preferably the toner has a volume average particle size of at least about 10 microns to avoid a dust problem in the copying apparatus, but less than 40 microns so that an adequate image with good resolution can be obtained, even on rough paper. For a plain paper copier preferably the toner volume average particle size is from about 10 to about 20 microns, and for a coated paper copier from about 15 to about 30 microns.

Preferably the dielectric constant of the toner is from about 2.5 to about 6 and the loss tangent is from about 0.005 to about 0.03. Dielectric constant and loss tangent values given herein are determined according to the Xerox method described in "Dielectric Measurement of Toner", procedure 2 of Attachment III to "9200 Minimum Physical Property Guidelines" (revised May 13, 1975), R. R. Sparacino, Information Technology Group, Xerox Corporation, Rochester, N.Y. In this method, the toner particles are pressed into a disk with a force of 14,000 psi and then the dielectric constant and loss tangent are measured at a constant frequency of 1 KHZ on a Hewlett Packard Automatic Capacitance Bridge Model 4270A or equivalent device.

The toner resin can be any resin that is compatible with the ferrous carbon. Typical of such resins are polyamides, polyurethanes, epoxy, vinyl resins, and polymeric esterification products of a dicarboxylic acid and a diol comprising a diphenol. Any suitable vinyl resin can be employed in the toners of the present system including homopolymers or copolymers of two or more vinyl monomers. Exemplary of such vinyl monomeric units are: styrene; p-chlorostyrene; vinyl naphthalene; ethylenically unsaturated mono-olefins such as ethylene, propylene, butylene, isobutylene and the like; vinyl compounds such as vinyl chloride, vinyl bromide, and vinyl fluoride; vinyl esters such as vinyl acetate, vinyl propionate, vinyl benzoate and the like; esters of alpha methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloracrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrol, N-vinyl carbozole, N-vinyl indole, N-vinyl pyrrolidene and the like; and mixtures thereof. The resin can be provided in emulsion slurry form and preferably as an aqueous emulsion or slurry.

Suitable resins for the binder are described in detail in U.S. Pat. No. 4,218,530, which is incorporated herein by this reference.

A variety of minor ingredients can be included in the monocomponent toners, as well known to the art. Exemplary of such materials are pigments, dyes, humidity control materials, waxes, metallic soaps, higher fatty acids, emulsifiers, and higher alcohols contained in small amounts.

Any method of toner particle formation that results in toner of the desired properties can be utilized in the present invention. Typical of such methods are hot melt formation and mastication followed by attrition to the toner particle size. In this method the ferrous carbon is dispersed in a resin, the dispersion is kneaded under heating, the dispersion is cooled and pulverized into fine particles, and the fine particles are classified to collect a toner having the desired particle size.

The preferred method for forming a toner is by dispersing the resin and ferrous carbon in a solvent, granulating the dispersion with a spray dryer, and classifying the resulting particles.

The solvent used for spray drying can be any material capable of dissolving or dispersing the toner resin without adversely affecting the ferrous carbon. Solvents and dispersants for processing toners are well known, including water and hydrocarbons such as alcohols, ketones, esters, amides, and fluorinated hydrocarbons. The solvent or dispersant is generally used in an amount such that the solid content of the solvent slurry is from about 5 to about 40 percent by weight. The term "solid content" is used to indicate the solids resulting from spray drying which include the resin, ferrous carbon, plus any other additives.

Any suitable spray drying equipment can be used in the formation of the toner. Generally the temperature of the spray drying is regulated to be near the boiling point of the solvent utilized. Spray drying to form toners is described in detail in the aforementioned U.S. Pat. No. 4,218,530.

By including ferrous carbon in the toner, only two ingredients are required, binder and ferrous carbon, rather than three ingredients. The ferrous carbon can replace the magnetic material and the pigment, serving as both. This results in a toner that is easier to manufacture and that can be made of uniform quality.

Another advantage resulting from using ferrous carbon in toner is that it is less expensive than some magnetic materials commonly used, such as zinc doped magnetite. Also, using ferrous carbon does not increase the bulk density of the toner as does the use of magnetite and other commonly used magnetic materials.

Toner For Dual Component System

Preferably the toner of the dual component system made according to the present invention is used with a carrier according to the present invention, and vice versa. However, this is not necessary. The toner must give the desired physical properties to the the developed image and the proper triboelectric relationship to match the carrier particles used because in a magnetic-brush development arrangement, the toner clings to the carrier by triboelectric attraction.

Preferably there is sufficient ferrous carbon that (i) the toner can produce a visible, black image, on paper, (ii) the toner has a magnetic moment of about 5 to about 15 emu/gram, and (iii) the toner has a resistivity of from about $10^{10}$ to about $10^{14}$ ohm-cm.

Thus, the weight ratio of binder or resin to ferrous carbon in the toner is from about 17:3 to about 50:1, i.e., if the toner contained only resin and ferrous carbon it would contain from about 85 to about 98% by weight resin and from about 2 to about 15% by weight carbon. The weight ratio needs to be at least about 17:3 or else the toner has such a high magnetic moment, i.e., greater than about 15 emu/gram, that the toner does not leave the magnetic brush. The weight ratio needs to be no more than about 50:1 or else there is inadequate ferrous carbon for the toner to have a magnetic moment of at least about 5 emu/gram so that there is magnetic attraction of the toner to the magnetic brush.

Because the ferrous carbon can be tailor made for any toner by varying the metal content and the form of the metal to vary the "blackness", magnetic moment, and resistivity of the ferrous carbon, it is easy to tailor a particular toner for a particular use, without having to add additional ingredients to the toner.

Preferably the dual component toner has a volume average particle size of from about 10 to about 20 microns. The toner is at least about 10 microns in diameter to avoid a dust problem in the copying apparatus, but less than about 20 microns so that an adequate image with good resolution can be obtained, even on rough paper. The toner resin or binder can be any resin that is compatible with the ferrous carbon, including the resins described above as useful for toners of monocomponent systems. Likewise, the same minor ingredients that can be used with a monocomponent toner can be used with a dual component system. Also, any method of toner particle formation that can be used with a monocomponent toner can be used with a toner for a dual component system. The preferred method for forming a toner for a dual component system in a coated paper copier is spray drying, as discussed above, using the same technique and solvent or dispersant, as discussed above. For a dual component system in a plain paper copier the toner is preferably formed by hot melt formation and mastication followed by attrition to the toner particle size. Also, any of the minor ingredients used in monocomponent toners can be used in dual component toners.

Toners for dual component systems according to the present invention are advantageous to use because of the advantages obtained by slightly magnetizing the toner. In particular, toner particles not drawn from the magnetic brush by electrostatic attraction remain on the magnetic brush due to magnetic attraction, avoiding powder clouding on the paper and a dirty background on the paper. Powder migration around the machine can also be controlled by use of magnets and magnetic filters. Further, by replacing the pigment normally used in the toner, such as carbon black, with ferrous carbon, the advantages of a magnetic toner are realized without increasing the number of ingredients used in the toner. Further, the bulk density of the toner is either not increased or increased only slightly. Thus, the customer still gets the same amount of copying per pound of toner, without an increase in attrition of the carrier particles and toner impaction. Because the ferrous carbon can be added to the binder in quantities as high as 15% by weight, uniform dispersion of the ferrous carbon in the binder is readily achieved. If the ferrous carbon could be added only in small quantities in the order of 1% by weight, it would be difficult to obtain a uniform dispersion of the ferrous carbon in the binder.

Carrier For Dual Component System

A particulate, conductive, magnetic carrier for use in a dry dual component developer for developing electrostatic charge patterns comprises binder and ferrous carbon. Preferably the ferrous carbon contains at least about 15% by weight iron, preferably in the alpha form, so that the carrier has a magnetic moment of at least about 25 emu/gram and a resistivity of no more than about $10^{16}$ ohm-cm. Otherwise it is difficult to impart to the carrier sufficient magnetic moment that the carrier is magnetically attracted sufficiently to form a magnetic brush.

Preferably the ferrous carbon contains no more than about 80% by weight iron or else the ferrous carbon can be a fire hazard durng its manufacture when first exposed to air and unduly expensive for use in toners. More preferably the ferrous carbon contains from about 20 to about 60% by weight iron.

Preferably there is sufficient ferrous carbon that (i) the carrier has a magnetic moment of at least about 25 emu/gram and (ii) the carrier has a resistivity of at least about $10^6$ to about $10^{16}$ ohm-cm. Accordingly, the weight ratio of binder or resin to ferrous carbon in the carrier is from about 1:4 to about 50:1, i.e., if the carrier contained only resin and carbon it would contain from about 20 to about 98% by weight resin and about 2 to about 80% by weight carbon. The weight ratio needs to be at least about 1:4 to have a sufficiently high resistivity to develop electrostatic images. The weight ratio needs to be less than about 50:1 or else there is inadequate ferrous carbon for the toner to have a sufficiently high magnetic moment and a sufficiently low resistivity to develop electrostatic images.

Preferably the magnetic moment of the carrier is no more than about 135 emu/gram or else the ferrous carbon requires more than about 80% by weight iron, the disadvantages of which are discussed above, or the toner requires a weight ratio of resin to ferrous carbon of less than about 1:4, the disadvantage of which is discussed above.

Because the ferrous carbon can be tailor made for any carrier by varying the metal content and the form of the metal to vary the magnetic moment and resistivity of the ferrous carbon, it is easy to tailor a particular carrier for a particular use, without having to add additional ingredients to the carrier.

Because the ferrous carbon has a density of from about 2 to about 7 gram/cc, the carrier has, as an upper limit, a density of less than about 6 gram/cc, and generally from only about 1.5 to about 4 gram/cc, thereby providing a soft brush with few image imperfections. For a plain paper copier preferably the carrier volume average particle size is from about 40 to about 100 microns, and for a coated paper copier from about 30 to about 60 microns.

The binder of the carrier particles may be any nonmetallic material which possesses sufficient difference in triboelectric properties from the toner particles and is compatible with the ferrous carbon. Generally the binder may be glass or a film-forming binder which is preferably a natural or thermoplastic or thermosetting resin or a mixture of such resins having appropriate mechanical and triboelectric properties. Appropriate monomers which can be used to prepare resins for this use include for example, vinyl monomers, such as alkyl acrylates and methacrylates, styrene and substituted styrenes, and vinyl pyridines. Copolymers prepared with these and other vinyl monomers, such as acidic monomers, e.g., acrylic or methacrylic acid, can be used. Such copolymers can advantageously contain small amounts of polyfunctional monomers, such as divinylbenzene, glycol dimethacrylate and triallyl citrate. It is preferred that the binder be either semiconductive or electrically insulating.

Suitable resins for the carrier are described in detail in U.S. Pat. No. 4,148,640 which is incorporated herein by this reference.

A variety of minor ingredients, can be included in the carrier, as is well known to the art.

Any method of carrier particle formation that results in carrier particles of the desired properties can be utilized in the present invention. The methods described above for formation of monocomponent toner particles are suitable for forming carrier particles of the present invention.

By using ferrous carbon in the carrier particles, it is now possible to design carrier particles having specific electric and magnetic properties which are useful for a specific copying machine.

Another advantage of the carrier particles of the present invention is that they do not have an unduly high bulk density because the composite material, i.e. the binder and the ferrous carbon has a bulk density lower than that of the material for which it can be substituted such as iron, magnetite, or steel. This results in a soft brush and helps prevent destruction of the carrier particles by attrition and toner impaction.

EXAMPLES 1-5

Five toners were made for use in a monocomponent system. The ferrous carbons used in the toners were made in a fluidized bed in accordance with the method described in the aforementioned U.S. patent application Ser. No. 339,778. The fluidized bed used was cylindrical in shape, with an inside diameter of 10 cm and a height of 5 meters. Into this reactor was placed a reactant mass of 3825 grams of malleable iron shot having a size range of about 180 to about 240 microns. The iron particles had been partially oxidized to produce an oxidized mass of 3900 grams. The oxidized iron shot was admixed with 2000 grams of aluminum oxide abradant, −40, +54 Tyler mesh. After raising the reactor temperature to about 470° C. by means of external heaters, a gaseous mixture comprising 30% carbon monoxide, 5% hydrogen, and 65% nitrogen on a dry gas basis was passed through the reactor. The gas mixture also contained about 3% water vapor by volume during the first few hours of operation. The volumetric gas flow rate through the fluidized bed was 2.9 standard liters per second. The superficial velocity of the gas was 70 cm/sec. The nominal bed temperature was 470° C.; the nominal pressure, 800 torr.

During the run, solid carbon was deposited in the bed through disproportionation of the carbon monoxide in the feed gas. Solid material, in the form of carbon ferrous metal component fragments, was removed from the bed by elutriation. The solid material was then removed from the gas stream by inertial means and by filtration. The collected solid material constituted the ferrous carbon. During the run, which lasted for about 98 hours, about 14 kilograms of carbon were deposited in the bed. At the end of the run, the collected product had a mass of 20 kilograms. The ferrous carbon used for Examples 1 and 2 had a volume average particle size of about 37 microns. After ultrasonic treatment, to reduce agglomeration, the ferrous carbon used for Examples 1 and 2 had a volume average particle size of about 14 microns. The ferrous carbon used for Examples 3–5 had a volume average particle size of about 14 microns. The ferrous carbon selected for use in the monocomponent toner of example 1 and 2, contained about 53% by weight carbon, about 0.6% by weight hydrogen, and about 44% by weight iron and had a magnetic moment of about 77 emu/gram measured at 6 Koe. The ferrous carbon selected for use in the monocomponent toners of examples 3–5 contained about 69% by weight carbon, about 0.8% by weight hydrogen, and about 27% by weight iron, and had a magnetic moment of about 39 emu/gram measured at 4.2 Koe. The iron present in both ferrous carbons was not analyzed, but is believed to have contained various iron carbides, principally $Fe_3C$, and some amounts of iron and possibly small amounts of iron oxide(s).

The constituents for forming the toner are presented in Table 1. The resin used was a polyethylene wax in an aqueous emulsion having 35% solids and was manufactured by Knapp Chemicals of Fresno, Calif., Catalog Number PEN-92.

The ferrous carbon and water were placed in a five gallon container and mixed in a Cowles Dissolver at 2500 rpm. The mixer had a high shearing mixing head on the shaft. The resin was added as an aqueous emulsion. The ammonia, where used, and the dispersing agent were added in increments, and each formulation was mixed until adequate dispersion was obtained.

The mix was then pressure fed to a spray dryer made by Bowen Engineering having a diameter of 3 feet. The inlet temperature was 225°0 C. and the outlet temperature was 85°0 C. Upon exiting the drier, the toner was entrained in an air stream and fed to a cyclone. The product fell into a capture bucket where it was removed and classified on a 200 mesh Tyler sieve screen.

The -200 mesh toner was then loaded into the hopper of an SCM Model 152 dry toner, coated paper copier. All batches of toner produced a photocopy which was very readable. However, the background areas had a grey appearance, with the background of the copies produced with the toner of Example 2 darker than the copies produced with the toners of the first, third and fourth examples. The Example 1 copy had some streaking, believed to have been caused by uneven feed in the copier. This may have resulted from the spray drier getting too hot for the first Example, causing some of the toner particles to fuse to one another, which in turn led to a partially blocked hopper feed mechanism. The best batch copies were produced with the toner of Example 5 in that copies had much less grey background than copies from the toners of Examples 1–4.

TABLE 1

Composition and Properties of Toners

| | Example Number | | | | |
|---|---|---|---|---|---|
| | 1 | 2 | 3 | 4 | 5 |
| Ferrous Carbon (kg) | 0.9 | 0.9 | 0.68 | 0.68 | 1.06 |
| Resin, 35% Solids (kg) | 0.65 | 0.65 | 0.45 | 0.85 | 0.75 |
| Water (kg) | 3 | 3.1 | 1.14 | 1.8 | 2.95 |
| Ammonia (28% Water Solution) (kg) | 0.2 | | 0.2* | 0.2* | 0 |
| Tamol 850 (Dispersing Agent, Rohm and Haas) (kg) | 0.03* | 0.03* | 0.03 | 0.06 | 0 |
| Maraspere BOS-3 (Dispersing Agent, Reed Lignin, Inc. Streator, Ill.) | 0 | 0 | 0 | 0 | 0.04 |
| Silicone AF75 (Anti-foaming Agent) (kg) | ¼ 0.03 | ¼ 0.03 | ¼ 0.03 | ¼ 0.03 | 0 |
| Solids by Weight | 25 | 33 | 33 | 27 | 28 |
| Mixing Time (hr) | 0.5* | 0.5* | 0.5* | 0.5* | 3.5 |
| Magnetic Moment (emu/gram) | 27 | 28 | 67 | 43 | 45 |

*Approximate value

Although the present invention has been described in considerable detail with reference to certain preferred versions thereof, other versions are possible. For example, rather than replacing all of the black pigment such as carbon black and magnetic material such as magnetite in prior art toners with ferrous carbon, it is possible to replace only a portion of the pigment and/or a portion of the magnetic material with ferrous carbon. Likewise, in carrier particles it is not necessary to replace all of the previously used magnetic material such as magnetite with ferrous carbon; the particles can contain both ferrous carbon and other magnetic material such as magnetite. Therefore the spirit and scope of the appended claims should not be limited to the description of the preferred versions contained herein.

What is claimed is:

1. A particulate, conductive, magnetic toner for use as a one component developer for developing electrostatic charge patterns, the toner comprising:

(a) a binder that is solid at ambient temperature and that is rendered molten under heating; and (b) ferrous carbon in an amount sufficient that (i) the toner can produce a visible, black image on paper, (ii) the toner has a magnetic moment of at least about 20 emu/gram, and (iii) the toner has a resistivity of from about $10^6$ to about $10^{17}$ ohm-cm, the ferrous carbon containing from about 15 to about 80% by weight ferrous metal and from about 20 to about 85% by weight carbon, the ferrous carbon being a fibrous, particulate carbonaceous material comprising carbon fibers and a ferrous group metal component dispersed throughout the carbon fibers as nodules that are intimately associated with and at least partially bonded to the carbon fibers.

2. The toner of claim 1 having a volume average particle size of at least about 10 microns.

3. The toner of claim 1, additionally comprising carbon black.

4. The toner of claim 1 additionally comprising magnetite.

5. The toner of claim 1 in which the ferrous group metal component is iron.

6. The toner of claim 5 having a volume average particle size of no more than about 40 microns.

7. The toner of claim 5 in which the ferrous carbon has a magnetic moment of up to about 160 emu/gram.

8. The toner of claim 5 having a dielectric constant of from about 2.5 to about 6.

9. The toner of claim 5 having a loss tangent of from about 0.005 to about 0.03.

10. The toner of claim 5 in which the weight ratio of binder to ferrous carbon is at least about 3:17.

11. The toner of claim 5 in which the weight ratio of binder to ferrous carbon is from about 3:17 to about 50:1.

12. The toner of claim 5 in which the weight ratio of binder to ferrous carbon is no more than about 50:1.

13. The toner of claim 5 in which the ferrous carbon has a density of from about 2 to about 7 grams/cc.

14. The toner of claim 13 having a density of less than about 2.5 gram/cc.

15. A particulate, magnetic, conductive carrier for use in a dry developer for developing electrostatic charge patterns, the developer comprising particulate toner and particulate carrier, the carrier comprising:

(a) binder;

(b) ferrous carbon in an amount sufficient that the carrier has (i) a magnetic moment of at least about 25 emu/gram and (ii) a resistivity of about $10^6$ to about $10^{16}$ ohm-cm, the ferrous carbon containing from about 15 to about 80% by weight ferrous metal and from about 20 to about 85% by weight carbon, the ferrous carbon being a fibrous, particulate carbonaceous material comprising carbon fibers and a ferrous group metal component dispersed throughout the carbon fibers as nodules that are intimately associated with and at least partially bonded to the carbon fibers.

16. The carrier of claim 15 having a volume average particle size of at least about 20 microns.

17. The carrier of claim 15 additionally comprising magnetite.

18. The carrier of claim 15 in which the ferrous group metal component is iron.

19. The carrier of claim 18 having a volume average particle size of no more than about 80 microns.

20. The carrier of claim 18 in which the ferrous carbon has a magnetic moment of up to about 160 emu/gram.

21. The carrier of claim 18 in which the ferrous carbon has a density of from about 2 to about 7 gram/cc.

22. The carrier of claim 18 having a density of less than about 2.5 grams/cc.

23. The carrier of claim 18 having a weight ratio of binder to ferrous carbon of from about 1:4 to about 50:1.

24. A particulate, magnetic, conductive toner for use in a dry developer for developing electrostatic charge patterns, the developer comprising particulate toner and particulate carrier, the toner comprising:

(a) a binder that is solid at ambient temperature and that is rendered molten under heating; and (b) ferrous carbon in an amount sufficient that (i) the toner can produce a visible, black image on paper, (ii) the toner has a magnetic moment of from about 5 to about 15 emu/gram and (iii) the toner has a resistivity of from $10^{10}$ to $10^{14}$ ohm-cm, the ferrous carbon containing from about 15 to about 80% by weight ferrous metal and from about 20 to about 85% by weight carbon, the ferrous carbon being a fibrous, particulate carbonaceous material comprising carbon fibers and a ferrous group metal component dispersed throughout the carbon fibers as nodules that are intimately associated with and at least partially bonded to the carbon fibers.

25. The toner of claim 24 having an average particle size of at least about 10 microns.

26. The toner of claim 24 additionally comprising carbon black.

27. The toner of claim 24 in which the ferrous group metal component is iron.

28. The toner of claim 27 having a weight ratio of binder to ferrous carbon of at least about 17:3.

29. The toner of claim 27 having a weight ratio of binder to ferrous carbon of from about 17:3 to about 50:1.

30. The toner of claim 27 having a weight ratio of binder to ferrous carbon of no more than about 50:1.

31. The toner of claim 27 having a volume average particle size of no more than about 20 microns.

32. The toner of claim 27 in which the ferrous carbon has a magnetic moment of up to about 160 emu/gram.

33. The toner of claim 27 in which the ferrous carbon has a density of from about 2 to about 7 grams/cc.

34. The toner of claim 33 having a density of less than about 2.5 gram/cc.

35. A developer for developing electrostatic charge patterns, the developer comprising particulate carrier and particulate toner particles, I. the carrier comprising:

(a) a first binder; and (b) a first ferrous carbon in an amount sufficient that the carrier has (i) a magnetic moment of at least about 25 emu/gram and (ii) a resistivity of from about $10^6$ to about $10^{16}$ ohm-cm, the first ferrous carbon containing from about 15 to about 80% by weight ferrous metal and from about 20 to about 85% by weight carbon, the carrier having a volume average particle size of at least about 20 microns and a weight ratio of first binder to first ferrous carbon of from about 1:4 to about 50:1;

II. the toner comprising:

(a) a second binder that is solid at ambient temperature and that is rendered molten under heating; and (b) a second ferrous carbon in an amount sufficient that (i) the toner can produce a visible, black image on paper, (ii) the toner has a magnetic moment of from about 5 to about 15 emu/gram, and (iii) the toner has a resistivity of from about $10^{10}$ to about $10^{14}$ ohm-cm, the second ferrous carbon containing from about 15 to about 80% by weight ferrous metal and from about 20 to about 85% by weight carbon, the toner having a volume average particle size of at least about 10 microns and a weight ratio of second binder to second ferrous carbon of from about 17:3 to about 50:1;

both the first and second ferrous carbons being a fibrous particulate carbonaceous material comprising carbon fibers and a ferrous group metal component dispersed through the carbon fibers as nodules that are intimately associated with and at least partially bonded to the carbon fibers, wherein the first ferrous carbon and the second ferrous carbon can be the same or different and the first binder and the second binder can be the same or different.

36. The toner of claim 3 additionally comprising magnetite.

37. The toner of claim 24 additionally comprising magnetite.

38. The toner of claim 37 additionally comprising carbon black.

39. The toner of claim 1 in which the carbon fibers have diameter of from about 0.02 to about 2 microns.

40. The carrier of claim 15 in which the carbon fibers have a diameter of from about 0.02 to about 2 microns.

41. The toner of claim 24 in which the carbon fibers have a diameter of from about 0.02 to about 2 microns.

* * * * *